United States Patent [19]

Tanino

[11] Patent Number: 4,778,035

[45] Date of Patent: Oct. 18, 1988

[54] CAGE POSITION DISPLAY APPARATUS FOR AN ELEVATOR

[75] Inventor: Junichi Tanino, Inazawa, Japan

[73] Assignee: Mitsubishi Denki Kabushiki Kaisha, Japan

[21] Appl. No.: 31,608

[22] Filed: Mar. 30, 1987

[30] Foreign Application Priority Data

Mar. 31, 1986 [JP] Japan ..... 61-73369

[51] Int. Cl.[4] ..... B66B 3/02

[52] U.S. Cl. ..... 187/136

[58] Field of Search ..... 187/134, 136

[56] References Cited

U.S. PATENT DOCUMENTS 3,967,700 7/1976 Tur et al. ..... 187/136
3,995,719 12/1976 Mandel et al. ..... 187/29
4,102,437 7/1978 Mandel ..... 187/136
4,389,631 6/1983 Kajiyama et al. ..... 340/21

FOREIGN PATENT DOCUMENTS 49-20842 2/1974 Japan .
50-15249 2/1975 Japan .
56-99181 8/1981 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A cage position display apparatus for an elevator having a machine room controller including a first converter having a memory for converting binary signals representing positions of a cage into display codes corresponding to a particular floor arrangement of a building in which the elevator is installed, a cage position display device including a second converter for converting the display codes into corresponding driving signals and display unit operated on the basis of the driving signals for displaying the position of the cage, and a plurality of signal lines connecting the machine room controller to the cage position display unit to transmit the display codes therebetween. Therefore, display patterns can be readily altered merely by changing the contents of the memory in the machine room controller.

7 Claims, 6 Drawing Sheets

FIG. 3

| D3~D0 \ D6~D4 | 0 | 0 | 0 | 0 | 1 | 1 | 1 | 1 |
|---|---|---|---|---|---|---|---|---|
| | 0 | 0 | 1 | 1 | 0 | 0 | 1 | 1 |
| | 0 | 1 | 0 | 1 | 0 | 1 | 0 | 1 |
| 0000 | | 16 | 32 | 48 | | | | |
| 0001 | 1 | 17 | 33 | LB | | | | |
| 0010 | 2 | 18 | 34 | PH | | | | |
| 0011 | 3 | 19 | 35 | P | | | | |
| 0100 | 4 | 20 | 36 | L | | | | |
| 0101 | 5 | 21 | 37 | M | | | | |
| 0110 | 6 | 22 | 38 | R | | | | |
| 0111 | 7 | 23 | 39 | G | | | | |
| 1000 | 8 | 24 | 40 | M1 | | | | |
| 1001 | 9 | 25 | 41 | M2 | | | | |
| 1010 | 10 | 26 | 42 | M3 | | | | |
| 1011 | 11 | 27 | 43 | B5 | | | | |
| 1100 | 12 | 28 | 44 | B4 | | | | |
| 1101 | 13 | 29 | 45 | B3 | | | | |
| 1110 | 14 | 30 | 46 | B2 | | | | |
| 1111 | 15 | 31 | 47 | B1 | | | | |

| | D7 | D6 | D5 | D4 | D3 | D2 | D1 | D0 |
|---|---|---|---|---|---|---|---|---|
| N+00 | 0 | 0 | 1 | 1 | 1 | 1 | 1 | 1 |
| 01 | ↓ | ↓ | 0 | 0 | 0 | 0 | 0 | 1 |
| 02 | | | 0 | 0 | 0 | 0 | 1 | 0 |
| 03 | | | 1 | 1 | 0 | 1 | 0 | 0 |
| ⋮ | | | | | | | | |
| fd-1 | | | | | | | | |

(a)

(b)

FIG. 7
| A5~A0 \ A7.A6 | 00 | | | | | | | | 01 | | | | | | | | 10 | | | | | | | | 11 | | | | | | | |
|---|---|---|---|---|---|---|---|---|---|---|---|---|---|---|---|---|---|---|---|---|---|---|---|---|---|---|---|---|---|---|---|---|
| | a | h | m | k | g | s | f | n | b | c | p | ℓ | d | q | e | s | a | h | m | k | g | s | f | m | b | c | p | ℓ | d | q | e | s |
| 000000 | 0 | | | | | | | | | | | | | | | | 0 | | | | | | | | 0 | | | | | | | |
| 000001 | 0 | | | | | | | | | | | | | | | | 0 | | | | | | | | 0 | 1 | 0 | 0 | 1 | 0 | 0 | 0 |
| 000010 | 0 | | | | | | | | | | | | | | | | 1 | 0 | 0 | 1 | 1 | 0 | 1 | 0 | 1 | 1 | 0 | 1 | 0 | 0 | 1 | 0 |
| 000011 | 0 | | | | | | | | | | | | | | | | 1 | 0 | 0 | 1 | 0 | 0 | 1 | 0 | 1 | 1 | 0 | 1 | 1 | 0 | 1 | 0 |
10 DIGIT
1 DIGIT
FIG. 8
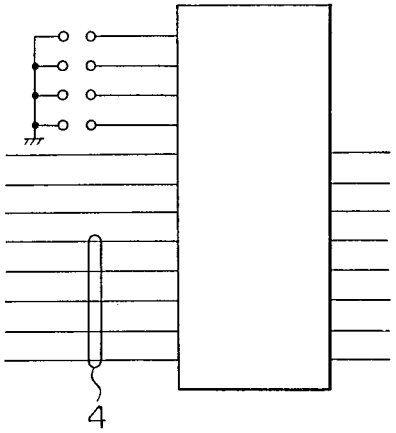
FIG. 9
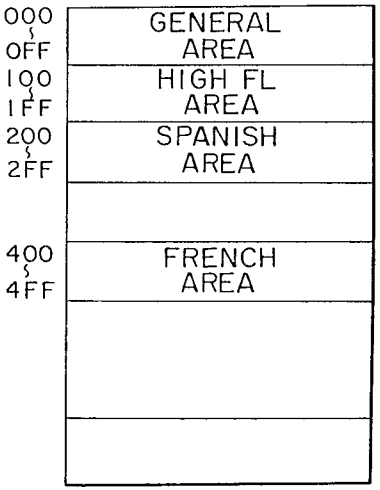

CAGE POSITION DISPLAY APPARATUS FOR AN ELEVATOR

BACKGROUND OF THE INVENTION

This invention relates to a cage position display apparatus for an elevator capable of altering a display character aspect.

FIG. 10 is a schematic arrangement diagram which shows by way of example a prior-art position display apparatus for an elevator system disclosed in Japanese Patent Application Publication No. 57391/1982 (U.S. Pat. NO. 3,995,719). Numeral 1 designates means provided in a machinery room-control device 10 for generating a binary signal expressive of a cage position. Memory means 2 disposed in a display device 11 receives the outputs from the binary signal generation means 1 through signal lines 4, and delivers positional character signals corresponding to a pertinent cage position. Display means 3 receives the positional character signals through internal wiring 5, and presents a character display.

Next, the operation of the prior-art apparatus will be explained on the basis of the above construction. When a cage passes through or stops at each floor within the hoistway of the elevator, the machinery room-control device 10 receives a position signal indicative of the floor from a predetermined position detection mechanism. The position signal is converted by the binary signal generation means 1 into a binary signal, which is sent to the memory means 2 of the display device 11 through the signal lines 4. The binary signal represents an address of the memory means 2 which stores in its contents corresponding cage positions in accordance with a predetermined arrangement. The display device 11 is then operated to read out from the memory means 2 and to send to the display means 3 through the internal wiring 5 the corresponding page position.

As understood from the above example of the operation, even in a case where the number of the signal lines 4 laid between the binary signal generation means 1 of the machine room control device 10 and the memory means 2 of the display device 11 and the number of the wiring leads 5 laid between the memory means 2 and the display means 3 are fixed, an expressing format for respective floors can be readily altered to a symbolism specific to a building by altering the content of the memory means 2 (for example, "1" indicative of the first floor can be altered to "G" indicative of the ground floor). Besides, the field wiring of the machine room control device 10 (usually located at the top part of the building) as well as the display device 11 can be simplified and can also be standardized.

The prior-art position display apparatus for the elevator system is constructed and operated as described above, and it is very effective in case of installing the position display device 11 in the cage only.

However, it is often necessary to display the cage position, not only in the cage, but also in the halls of the respective floors as illustrated in FIG. 11. Accordingly, in an elevator which stops at 32 floors by way of example, the memory means 2 storing a predetermined floor arrangement are disposed in the cage and all 32 elevator halls, totaling 33 units. When there is a need to change a display symbolism or floor arrangement, the contents of all these memory means 2 need to be altered. Specifically, the display symbols "L" corresponding to the first floor and "1" corresponding to the second floor provided in the memory contents of 33 units of the memory means 2 need to be changed and replaced by "1" and "L", respectively, when the second floor is now made the lobby. Clearly, every time there is a change, all the memory units are replaced since their memory contents are often set permanently according to a specific floor arrangement. This replacement task is very time-consuming and expensive since new units and additional labor are required. On the other hand, to eliminate such a drawback, it is considered to install a single memory means 2 in the machine room control device 10 and only the individual display means 3 in the cage and elevator halls of the respective floors and to place field wires connecting the memory means 2 to the display means 3 within the hoistway. However, by so doing, the number of field wires increases dramatically, lowering reliability due to exposure and poor maintainability. Particularly, when individual memory means 2 are disposed in the position display devices 11, there are only 5 field wires connecting between the binary signal generation means 1 of the machine room control device 10 and the memory means 2 and corresponding to a 5-bit representation of 32 decimal display symbols for 32 floors. When the single memory means 2 in disposed in the machine room control device 10, 14 field wires corresponding to a 14-bit representation of two 7-segment display units required for displaying up to 99 symbols are needed for the connection to the display means 3. If two 16-segment display units are employed for each display means 3 (and there are 33 display means for 32 elevator halls and a cage), there will be 33 parallel connections, each with 32 field wires coming out of the machine room control device 10. As the number of floors and elevator cages increases, the number of field wires maintained within the hoistway is prohibitively large.

SUMMARY OF THE INVENTION

This invention has the objective of eliminating the problems as stated above, and has for its main object to provide a cage position display apparatus for an elevator having a much smaller number of field wires as compared with the foregoing measure, and which can readily alter a format of expressing respective floors.

The cage position display apparatus for an elevator according to this invention includes binary signal generation means disposed in the machine room control device for converting the position signals representative of cage positions into binary signals and memory means capable of storing specific expressing formats for respective floors to a building, properly for the respective floors, and for reading out an expression signal of each floor therefrom with the binary number of the floor used as an address signal, while the side of each of the display devices of a cage and respective floor halls is furnished with a memory whose addresses are the floor expressing signals and which stores floor expressing information items at the respective addresses, and display means for displaying a character corresponding to the floor expressing information read out from the memory, with the expressing information used as display segment driving signals.

The memory means disposed on the side of the machine control room in this invention stores the expression information items of the respective floors specific to the building beforehand at addresses generated on the basis of respective floor signals, and it reads out the corresponding expression information in such a way that the binary signal sent from the binary signal generation means each time the cage passes one floor is received as the address signal of the memory means. Further, the memory means on the machine control room side sends the read expression information as the memory address signal to the memory built in each display device through field wiring, and the memory of the display device reads out the display information coincident with the expression information therefrom and sends it to the display means. Thus, a cage position is displayed in the cage and the respective halls in the preset expressing format.

BRIEF DESCRIPTION OF THE DRAWINGS

FIG. 3 is a conversion table for converting the expressions of respective floors into binary signals;

FIG. 7 is a diagram for explaining the transmission of drive data in the case of driving the display means;

FIGS. 8 and 9 are diagrams for explaining a method of storing data in an E²PROM in another embodiment of this invention;

DESCRIPTION OF THE PREFERRED EMBODIMENT

Figure 1:
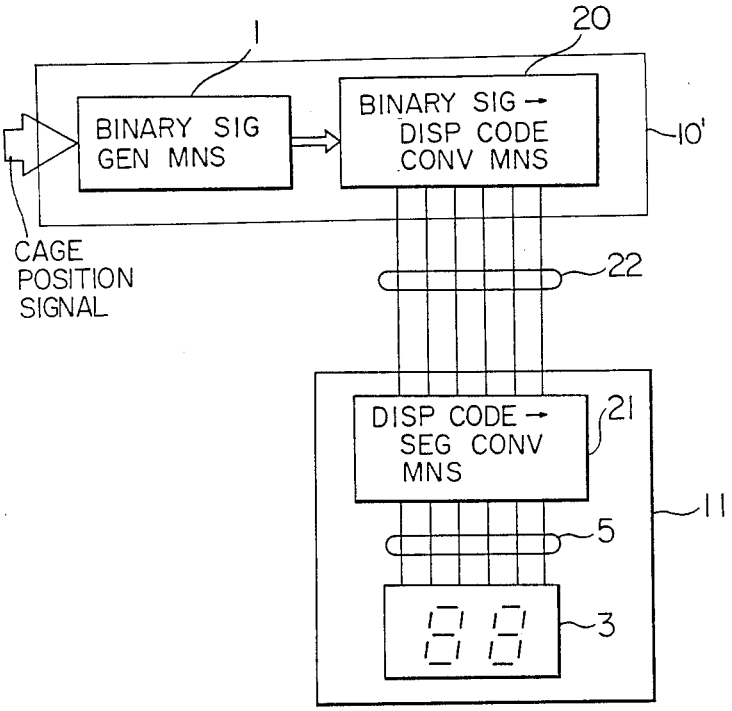
FIG. 1 is an arrangement diagram of a cage position display apparatus for an elevator in an embodiment of this invention.

Now, an embodiment of this invention will be described with reference to the drawings. In FIG. 1, numeral 1 designates binary signal generation means disposed in a machine room control device 10' provided at a part of the hoistway of an elevator for generating binary signals corresponding to positions of a cage represented by the cage position signals. Control conversion means 20 similarly disposed in the machine room control device 10' receives and converts the binary signals from the binary signal generation means 1 into floor display code signals. Display code-to-segment conversion means 21 is disposed in a display device 11' disposed in the cage or respective elevator halls to receive and convert the display code signals into corresponding drive signals. Shown at numeral 3 is display means including display segments operated by the drive signals for displaying the display code corresponding to the floor of a building where the cage lies.

Numeral 22 denotes field wires placed in the hoistway for transmitting the floor display code signals, from the control means 20 to the display code-to-segment conversion means 21. Numeral 5 denotes signal lines for transmitting the drive signals.

Figure 2:
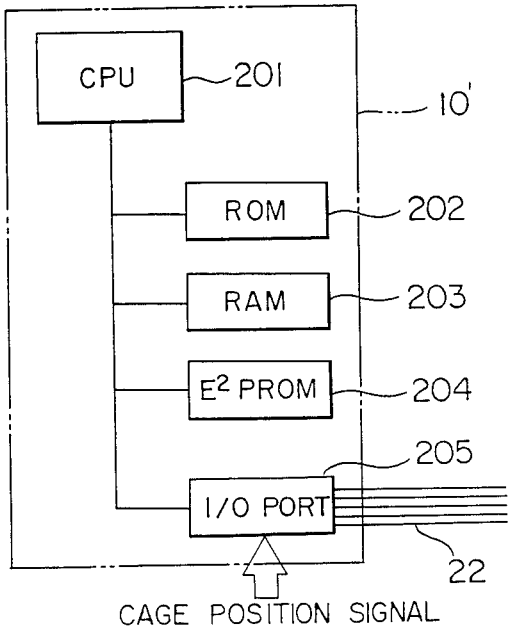
FIG. 2 is an internal arrangement diagram of binary signal-to-display code conversion means in the embodiment.
Figures 4, 5:
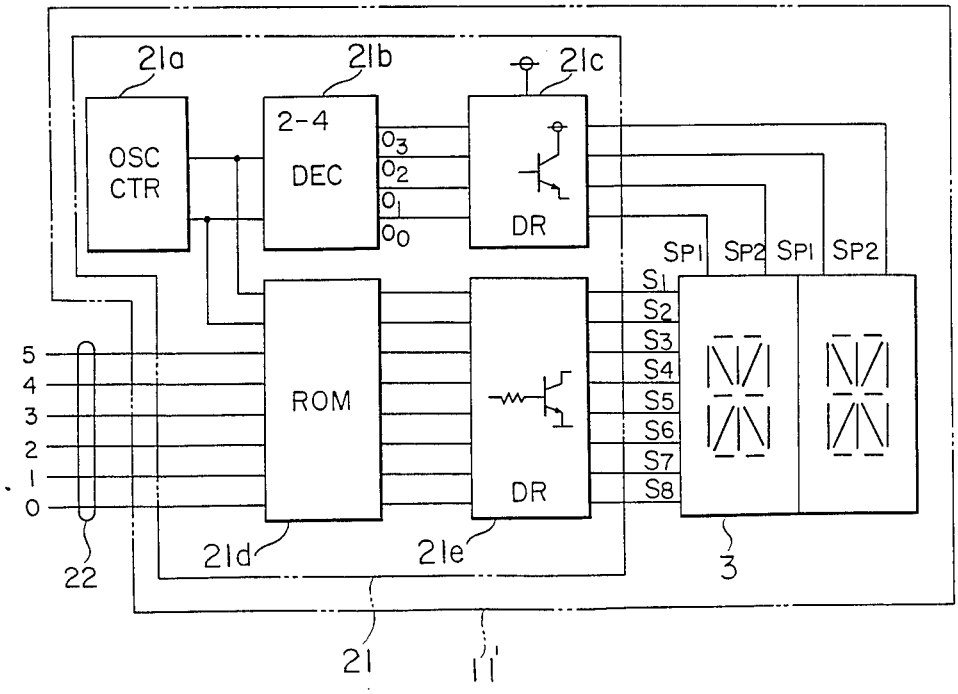
FIG. 4 is a diagram for explaining a floor expressing format specific to a building.
FIG. 5 is an arrangement diagram of a display device in the embodiment.

The operation of the machine room control device 10' will be described with reference to FIG. 2. As shown in Japanese Patent Application Laid-open No. 99181/1981 (U.S. Pat. No. 4,389,631), a floor position signal sent from the floor position detection mechanism of a predetermined cage is received at an I/O port 205 and converted into a binary signal indicative of a floor by a CPU 201. The binary signal is stored at one address of a RAM 203 in accordance with a program stored in a ROM 202. In this case, in order to set the first floor (the bottom floor) of the building to $(00)_2$, floor information with one subtracted from the actual floor fd is control means 20 operates to convert the binary signal into a display code in accordance with a program stored in the ROM 202. That is, the CPU 201 reads out the binary signal stored in the RAM 203, adds a value indicative of the data table area N of an E²PROM 204 to the read content so as to generate a memory address, and reads out the content of the E²PROM 204 corresponding to the address and delivers it to the I/O port 205. FIG. 3 shows a table illustrating the relationship between a floor arrangement specific to the building and the binary signals. The E²PROM 204 stores binary signal data ($D_0$–$D_6$) indicative of the floors in the order thereof, and, in the case of some buildings which have floor expressing formats specific thereto, a data table similar to the above is generated in another address space of the E²PROM 204 as shown in FIG. 4.

More specifically, the data items of the E²PROM 204 at addresses N+fd are so converted that the first floor (the bottom floor) of the building furnished with the elevator, which is to be displayed by "B1," is set at $(00111111)_2$, that the second floor to be displayed by "1" is set at $(00000001)_2$, that the third floor to be displayed by "2" is set at $(00000010)_2$, and that the fourth floor to be displayed by "L" is set at $(00110100)_2$.

Figure 6:
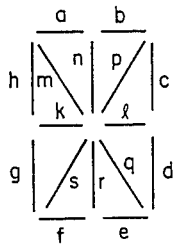
FIGS. 6(*a*) and 6(*b*) are arrangement diagrams of display means (display segments)
Figure 6:
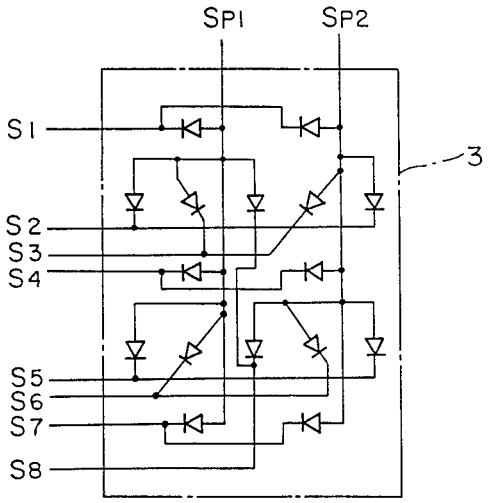
Figure 10:
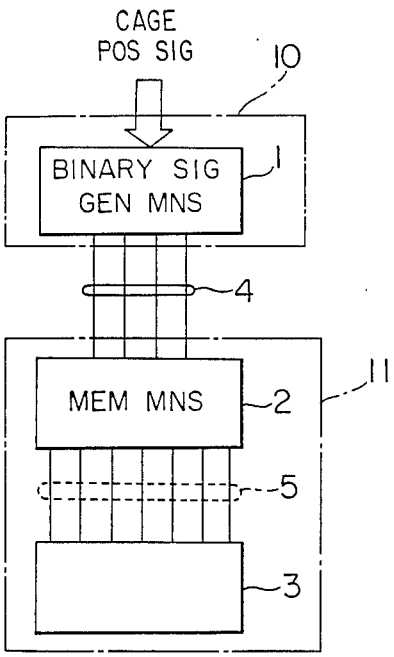
FIG. 10 PRIOR ART
FIG. 10 is an arrangement diagram showing a position display apparatus for an elevator system in a prior art.
Figure 11:
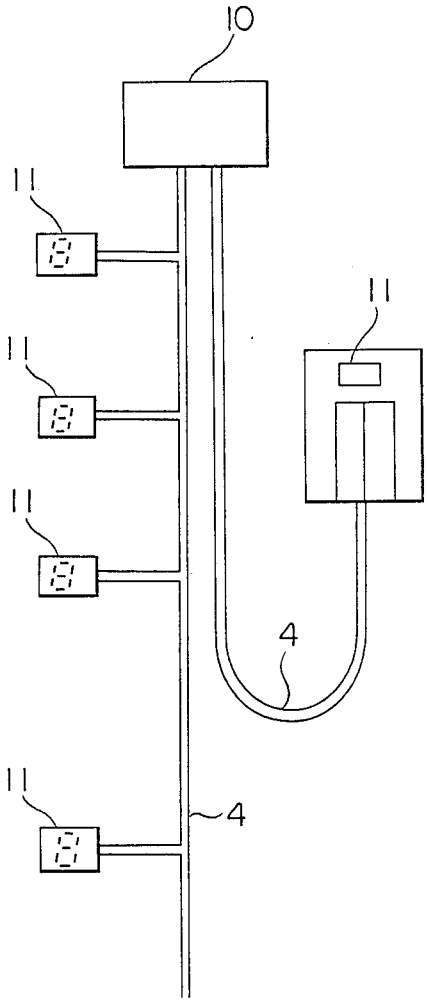
FIG. 11 is an explanatory diagram showing a method of arranging position display devices.

Next, the floor data composed of 6 bits as transferred from the I/O port 205 is sent to the display devices 11 arranged in the cage and on the respective floors, through the field wires 22 in the hoistway. Each of the display devices 11 is constructed of the display code-to-segment conversion means 21 and the display means 3 as shown in FIG. 5. The detailed configuration of the display means 3 is as shown in FIGS. 6(*a*) and 6(*b*). Each of display elements constituting the display means 3 is constructed of 16 segments. A plus potential and a minus potential are respectively applied to the anode side terminals $S_{p1}$, $S_{p2}$ and cathode side terminals $S_1$–$S_8$ of the segments, whereby an alphanumeric symbol is displayed by light emission. As seen from FIG. 5, the display code-to-segment conversion means 21 for controlling the light emission of the respective segments of the display element is constructed of a 2-bit counter 21*a* which has a built-in oscillator for cyclically oscillating logic signals of $(0, 0)_2$ $(0, 1)_2$, $(1, 0)_2$, $(1, 1)_2$, a 2-4 decoder 21*b* which selects the corresponding one of output terminals $O_0$–$O_3$ on the basis of the 2-bit logic signal and delivers an output signal, a plus side drive circuit 21*c* which applies the plus potential to the anode side terminal(s) $S_{p1}$ or/and $S_{p2}$ of the display elements on the basis of the output signal, a ROM 21*d* which receives as its address signal the 2-bit logic signal from the 2-bit counter 21*a* and the 6-bit signal (floor display code) delivered from the I/O port 205 of the control means 20 and which sends segment driving data for displaying numerals or letters corresponding to the floor display code on the display means 3, in accordance with the address, and a minus side driver circuit 21*e* which applies the minus potential to the cathode side terminals of the corresponding segments on the basis of the segment driving data.

Now, in order to present the display of the first floor on the respective display devices 11, the first-floor displaying data "0000001" is read out from the $E^2$PROM 204. While this data is delivered from the I/O port 205 to the address terminals of the ROM 21*d* of each display device 11, "1" is displayed on the display means 3 in accordance with a data format based on the illustration of FIG. 7. More specifically, this display operation proceeds as follows:

(1) When the output of the 2-bit counter 21*a* is $(0,0)_2$, the segments a, h, m, k, g, s, f and n of the display element of the tens digit are energized by the 2-4 decoder 21*b* and the plus side driver circuit 21*c*, and the minus side driver 21*e* puts out the segments owing to the outputs of the 2-bit counter 21*a* and the ROM 21*d* supplied with the 6-bit data, namely, all 0s.

(2) When the output of the 2-bit counter 21*a* is $(0, 1)_2$, the segments b, c, p, l, d, q, e and s of the display element of the tens digit are energized by the 2-4 decoder 21*b* and the plus side driver circuit 21*c*, and the minus side driver 21*e* puts out the segments owing to the outputs of the 2-bit counter 21*a* and the ROM 21*d* supplied with the 6-bit data, namely, all 0s.

(3) When the output of the 2-bit counter 21*a* is $(1, 0)_2$, the segments a, h, m, k, g, s, f and n of the display element of the units digit are energized by the 2-4 decoder 21*b* and the plus side driver circuit 21*c*, and the minus side driver 21*e* puts out the segments owing to the outputs of the 2-bit counter 21*a* and the ROM 21*d* supplied with the 6-bit data, namely, all 0s.

(4) When the output of the 2-bit counter 21*a* is $(1, 1)_2$, the segments b, c, p, l, d, q, e and s of the display element of the units digit are energized by the 2-4 decoder 21*b* and the plus side driver circuit 21*c*, and "1" is displayed, that is, the segments c and d are lit up by the outputs of the 2-bit counter 21*a* and the ROM 21*d* supplied with the 6-bit data.

Therefore, by scanning this circulation at a speed which is too fast to informatively recognize, "1" seems to be lit up owing to the residual image of the eye.

This invention is not restricted to the above embodiment, but is also capable of the following aspects:

[1] The display code-to-segment information conversion means is such that the segment display outputs exhibit fixed relations to the inputs in 1-to-1 correspondence. Therefore, it can be realized by gate logics and can be substituted by a single-chip device, such as gate array, which can be produced by a semiconductor device manufacturer.

[2] Although the display elements each being composed of 16 segments have been exemplified, mosaic display elements of 5×7 dots or display elements of 7 segments can be similarly employed.

[3] Although 64 kinds of display characters have been explained (this example can display up to 48 floor symbols+special symbols), an elevator for a high building which can exceed 100 floors can be coped with by increasing the number of field wires 22 to 7 (providing 128 display characters) or 8 (providing 256 display characters).

[4] Although the signals between the control device 10' and each display device 11' have been the parallel 6-bit signals, they may well be replaced with serialized signals. The serialization of the signals can diminish the number of signals. Besides, when the number of bits of the serialized signals is made smaller, the signal transmission speed rises, and the numbers of circuit elements in a serializer portion and a deserializer portion for the signals decrease, so that the same merits as in the transmission of the parallel signals are attained.

[5] As shown in FIGS. 8 and 9, jumper connectors are connected to the more-significant-bit addresses of the memory in the display device, whereby display patterns for the individual purposes or shipping destinations of elevators can be set by inserting jumper plugs into the connectors. Thus, the number of signals between the machine room and the cage can be fixed to the required minimum number.

As described above, according to this invention, the memory means storing expression information items for displaying respective floors is disposed in the machine room control device, binary expression information of preset bit format read out from the memory means on the basis of predetermined cage position information is sent to temporary memory portions of floor display devices on the respective floors and in a cage as memory address signals, so as to produce from the corresponding address of the memory means of the display devices driving signals for driving display segments of on the display devices. Therefore, the invention produces the effects that display patterns can be readily altered merely by changing the contents of the memory means in the machine room control device, and that connection lines to be wired to the respective display devices can be fixed and reduced in number.

What is claimed is:

1. A cage position display apparatus for an elevator comprising:

machine room control means including an alterable first conversion means for converting binary signals representing positions of a cage into display codes corresponding to a particular floor arrangement of a building in which the cage is installed;

a plurality of cage position display means, each cage position display means including a non-alterable second conversion means for converting the display codes into corresponding driving signals and means operated on the basis of said driving signals for displaying the position of the cage; and connecting means including a plurality of signal lines for connecting said machine room control means to each of said cage position display means to transmit the display codes therebetween.

2. A cage position display apparatus for an elevator as defined in claim 1 wherein said machine room control means is disposed in a part of a hoistway of the elevator, said cage position display means is disposed in a hall or a cage, and said signal lines of said connecting means are laid in said hoistway.

3. A cage position display apparatus for an elevator as defined in claim 2 wherein said first conversion means delivers signals of a predetermined minimum number of bits as the display code, and said signal lines are laid in a number necessary for transmitting the signals of the above number of bits.

4. A cage position display apparatus for an elevator as defined in claim 3 wherein the number of bits predetermined for said first conversion means is set at 6 in the building where floors of two digits are displayed, and said signal lines are laid in the number necessary for transmitting the 6-bit signals.

5. A cage position display apparatus as defined in claim 3 wherein the number of bits predetermined for said first conversion means is set at at least 7 in the building where floors of three digits are displayed, and said signal lines are laid in the same number necessary for transmitting the predetermined number of bits.

6. A cage position display apparatus for an elevator comprising:

machine room control means including an alterable first conversion means for converting binary signals representing positions of a cage into display codes corresponding to a particular floor arrangement of a building in which the cage is installed;

a plurality of cage position display means, each cage position display means including a non-alterable second conversion means for converting the display codes into corresponding driving signals and means operated on the basis of said driving signals for displaying the position of the cage; and connecting means including a plurality of signal lines for connecting said machine room control means to each of said cage position display means to transmit the display codes therebetween, said machine room control means being disposed in a part of a hoistway of the elevator, said cage position display means being disposed in a hall or a cage, and said signal lines of said connecting means being laid in said hoistway;

said first conversion means delivering signals of a predetermined minimum number of bits as the display code, and said signal lines being laid in a number necessary for transmitting the signals of the above number of bits;

said first conversion means serializing the bit signals and then delivering the serialized bit signals to said signal lines.

7. A cage position display apparatus for an elevator comprising:

machine room control means disposed in a part of a hoistway of the elevator and including a first conversion means for converting binary signals representing positions of a cage into display codes corresponding to a particular floor arrangement of a building in which the elevator is installed said first conversion means delivering signals of a predetermined minimum number of bits as the display codes;

cage position display means disposed in a hall or a cage and including a second conversion means for converting the display codes into corresponding driving signals and means operated on the basis of said driving signals for displaying the positions of the cage; and connecting means including a plurality of signal lines necessary for transmitting the signal of the above number of bits, said connecting means being laid in said hoistway for connecting said machine room control means to said cage position display means;

said cage position display means further comprising first memory means included in said first conversion means for converting the transmitted display codes into display signals, and said machine room control means further comprising:

(a) rewritable second memory means for storing a plurality of display formats for a plurality of floors corresponding to the display codes, (b) third memory means for storing commands controlling selection of any of the plurality of display formats for each of the binary signals expressive of the cage position, (c) rewritable fourth memory means for successively storing the display codes corresponding to the selected display formats for the respective floors, and (d) output means supplied with the display codes from said fourth memory means corresponding to the respective binary signals.

* * * * *